United States Patent [19]

Collings

[11] Patent Number: 4,842,350

[45] Date of Patent: Jun. 27, 1989

[54] BAR UNIT

[76] Inventor: James A. Collings, 4437 Magazine St., #B, New Orleans, La. 70115

[21] Appl. No.: 182,921

[22] Filed: Apr. 18, 1988

[51] Int. Cl.[4] ..... A47B 77/06

[52] U.S. Cl. ..... 312/228; 211/74; 312/293; 312/351

[58] Field of Search ..... 312/228, 229, 351, 140.4, 312/129, 131, 255, 256, 196, 293, 281; 248/188.4, 188.5; 211/74, 126, 175

[56] References Cited

U.S. PATENT DOCUMENTS

| | | | |
|---|---|---|---|
| 499,671 | 6/1893 | Gard et al. | 248/188.5 |
| 673,465 | 5/1901 | Annin | 312/228 X |
| 939,125 | 11/1909 | Fraly | 312/351 X |
| 2,425,232 | 8/1947 | Earle | 211/74 X |
| 2,498,402 | 2/1950 | Earle | 211/74 X |
| 2,538,233 | 1/1951 | Brandstrom | 312/229 |
| 2,558,955 | 7/1951 | Hilton | 312/351 X |
| 2,673,783 | 3/1954 | Rahm et al. | 312/293 X |
| 2,752,218 | 6/1956 | Shea | 312/255 |
| 3,074,773 | 1/1963 | Salgado | 312/293 X |
| 4,428,631 | 1/1984 | Cope et al. | 312/196 |

*Primary Examiner*—Kenneth J. Dorner
*Assistant Examiner*—Thomas A. Rendos
*Attorney, Agent, or Firm*—Keaty & Keaty

[57] ABSTRACT

The invention relates to bar units suitable for dispensing of ice and holding bottles and other paraphernalia necessary for work of a bartender. The bar unit provides for a housing having an inclined bottom and vertically extending walls supportable from the floor by legs which can be adjusted in height through telescopically movable elements. A first insert positionable within the housing has an arcuate wall to allow for easy scooping of ice from the housing. The insert has a horizontal attachment formed to occupy the spandrel space forward from the arcuate wall, the horizontal attachment having a number of chambers in which bins for retaining various bartenders' paraphernalia can be positioned. The bins follow the general shape of the horizontal attachment. A substitute bottom plate is provided for positioning within the housing to reduce the chamber formed by the housing when the amount of ice stored in the bar unit needs to be reduced. An elongated bin positionable inside the housing has a number of bottle holders inclined forward towards the front wall of the housing to allow for easy removal of the bottles positionable within the holders. A secondary attachment attached to the front wall of the housing provides additional containers for holding bottles in easily accessible space.

20 Claims, 4 Drawing Sheets

BAR UNIT

BACKGROUND OF THE INVENTION

The present invention relates to an improved cocktail mixing unit for use in restaurants, lounges and similar establishments, wherein drinks of various kinds are served.

More specifically, the present invention relates to a cocktail mixing unit which can be installed in place of the currently existing ice dispensing units under the bar counter, wherein the amount of ice stored in the ice dispensing unit can be varied depending on the amount of drinks which need to be served on any particular day.

The currently utilized ice dispensing units are traditionally installed under the bar counter and comprise a rectangularly shaped box supported by legs, the interior of the box serving as an ice container. These standard units extend to some distance below from the counter top and are provided with a closed bottom, vertically extending walls and an open top. The bottom of such box-shaped units is parallel to the floor.

The standard units are of a predetermined size and, as often the case, are below the level of convenience for scooping the ice by a bartender. Considering the number of times the bartender has to bend to scoop the ice from a low ice container, one could easily appreciate the physical strain to which a bartender is subjected, especially if the amount of ice stored in the container decreases and the bartender has to bend even lower to reach the ice at the bottom of the unit.

Additionally, the disadvantage of the presently available unit lies in the fact that a lot of space between the top of the unit and the counter top is wasted, without being utilized for the useful purpose of storing ice or other paraphernalia of a bartender.

A further disadvantage of the currently available units is the fact that, having the bottom of the unit in parallel to the floor, they require a lot of ice for filling the open chamber formed by a unit which has a substantially parallelepiped shape. In this manner, a lot of ice is wasted, by melting, when there are not so many customers on a particular day, which is generally referred to in the trade as a "slow night".

It is, therefore, an object of the present invention to provide a improved bar unit, which would be more convenient for use by bartenders by eliminating strain often associated with frequent bending when a bartender reaches for the ice in the ice dispensing unit.

It is a further object in the present invention to provide a bar unit, wherein the amount of ice stored in the container can be regulated, depending on the approximately estimated amount of ice to be dispensed on a particular day.

It is still a further object of the present invention to provide a bar unit, which utilizes the wasted space between the bar unit top and the counter top, thus allowing a more efficient dispensing of drinks by a bartender.

These and other objects of the invention will be more apparent to those skilled in the art from the foregoing description of the invention.

SUMMARY OF THE INVENTION

The present invention solves the problems associated with the prior art and achieves its objects in a simple and straightforward manner.

In accordance with the present invention, the improved bar unit comprises a housing having a shape approximating that of an oblique rectangular prism, supported from the floor by legs, which can be adjusted in height through telescopically movable elements to fill the space under the counter top. The bar unit is provided with an insert having a curved front wall and mountable inside the housing, while extending from a distance above the bottom to the top edge of the housing for easier and faster scooping of ice.

A secondary insert mountable within the housing forms a substitute bottom for the bar unit, at a height above the bottom of the housing. A pair of elongated bottle holders positionable adjacent the sides of the housing provide support for bottles at an inclined plane directed towards the front of the unit, so that bottles rest in the holders and are withdrawn from the holders, while the bartender exerts less effort in removing the bottles from the holders.

Additional insertable bins allow positioning of various paraphernalia, such as fruit, straws and the like, away from the counter top for sanitary reasons, and into the housing to allow easy dispensing of the objects by the bartender.

DETAILED DESCRIPTION OF THE PREFERRED EMBODIMENT

Figure 1:
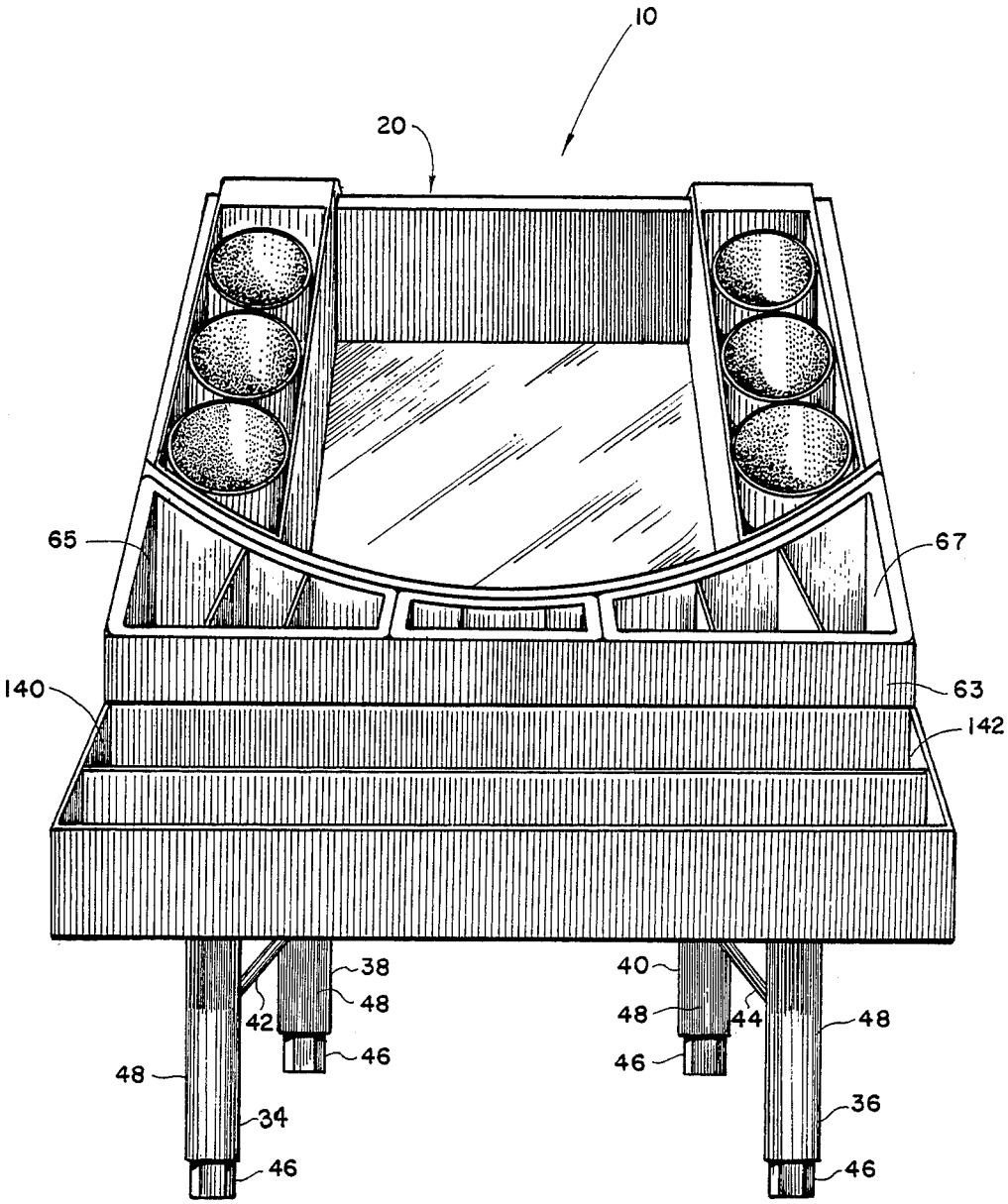
FIG. 1 is a perspective view of the apparatus of the present invention.

Referring now to the drawings, the bar unit in accordance with the present invention is generally designated by numeral 10. The bar unit 10 comprises a housing 20 having a shape approximating that of an oblique rectangular prism and provided with a bottom 22, vertically extending side walls 24 and 26, front wall 28 and back wall 30. A chamber 32 is formed by the bottom 22 and walls 24, 26, 28 and 30, the chamber 32 also having an oblique rectangular prism shape.

The housing 20 is supported from the floor by a pair of front legs 34 and 36 and rear legs 38 and 40.

The legs are held in their respective spaced relationship by a suitable brace means 42 and 44.

The legs 34, 36, 38 and 40 are comprised of two elements: lower portion 46 and upper portion 48 mounted in partially covering relationship on the lower portion 46 and adapted for a limited telescopical movement in relation to the lower portion 46.

The lower portions 46 have a polygonal cross-section and their length can be varied by applying torque to the exposed parts of the lower portions 46, thus causing them to either retreat into the confines of the upper portions 48 or advance downwards, so that the necessary degree of incline can be selected, when desired.

One could easily appreciate that the height adjustment of the legs 34, 36, 38 and 40 would allow various height positions for the housing 20 in relation to the horizontal plane formed by a floor 11.

A suitable drain outlet 52 is formed in the bottom 22 of the housing 20 at a location adjacent to the front wall 28.

The combined height of the rear legs 38 an 40 and the back wall 30 is such as to extend substantially up to the standard counter top of a bar of which the present bar unit forms a part.

Figure 2:
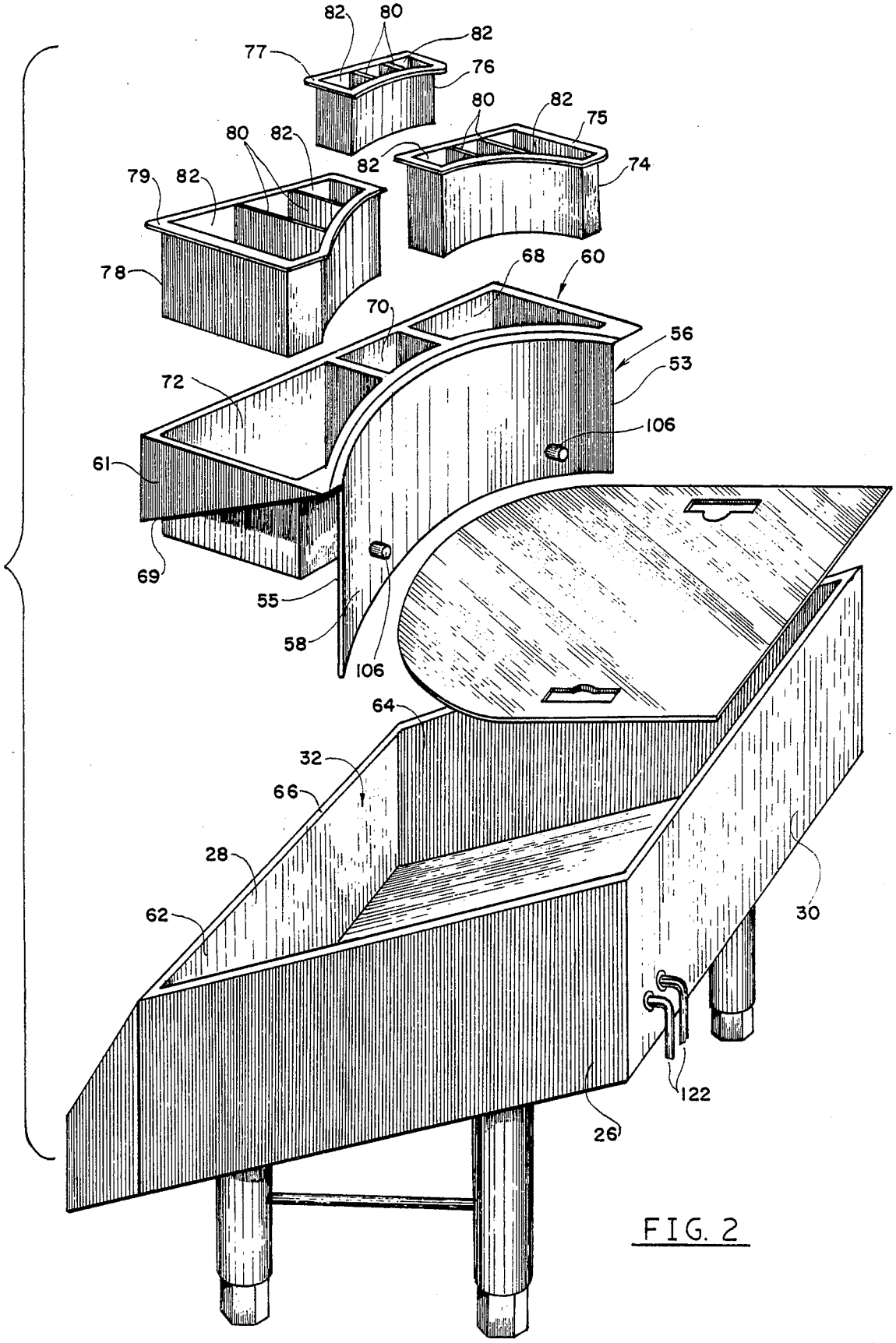
FIG. 2 is an exploded view of the apparatus of the present invention.

Referring now to FIG. 2, an arcuate insert 56 is shown to comprise an arcuate wall 58 having a height slightly smaller (or may be equal to) than the height of the front wall 28. The arc of the wall 58 extends from the side wall 24 to the side wall 26, so that when the insert 56 is positioned inside the chamber 32, the side ends 53, 55 of the arcuate wall 58 are flush with the remainder of the walls 24 and 26.

Extending perpendicularly to the top edge of the arcuate wall 58 is a horizontal attachment 60 which is designed in the form of spandrels to fill the spaces between the right and left exterior curve of the arcuate wall 58 and enclosing right angles 62 and 64. The attachment 60 is provided with a supporting means 61, for supporting the insert 56 on a top edge 66 of the housing 20 adjacent to the front wall 28. The supporting means 61 comprise a front support 63 resting on top edge of the front wall 28, the support 63 having a rectangular shape, and a pair of side supports 65 and 67 resting on the top edge of the side walls 24 and 26 adjacent to the front wall 28. The side supports 65 and 67 have a generally triangular shape which follows the inclined top edge of the walls 24 and 26 of the housing 20. The bottom edge 69 of the side supports 65 and 67 forms a hypotenuse of the triangles formed by side supports 65 and 67. The bottom edge 69 rests on top of the side walls 24 and 26. In this manner, the attachment 60 is suspended substantially horizontally from the housing 20.

The horizontal attachment 60 is provided with a number of irregular chambers 68, 70 and 72, which are designed to receive irregularly shaped bins 74, 76 and 78, respectively. The bins 74, 76 and 78 are divide by slidable plates 80 into a plurality of compartments 82 designed to house various wedges of fruit, such as lemons, limes, cherries, straws or other paraphernalia used by a bartender during work. Depending on the type of drinks which the bartender is designed to mix, the compartments can be enlarged by removing some of the slidable plates 80 from their position inside the bins 74, 76 or 78, so that if, for example, a bartender needs a lot of lemon slices, the slidable plate can be removed, enlarging a particular compartment for housing the lemon slices or wedges.

As one can appreciate, the height of the slidable plates is substantially equal to the height of the bins 74, 76 and 78, while the shape of the slidable plates 80 conforms to the cross-section of the bin at the particular space, occupied by the slidable plate 80. Still, when in place, the plates 80 separate the bins 74, 76 and 78 into compartments 82 which do not communicate with each other so that the taste of one fruit is not intermixed with the taste of another, which will be an undesirable effect while mixing drinks. A horizontal flange 75, 77 and 79 extends about the periphery of the bins 74, 76 and 78, respectively, to allow suspending of the bins 74, 76 and 78 from the attachment 60.

Figure 3:
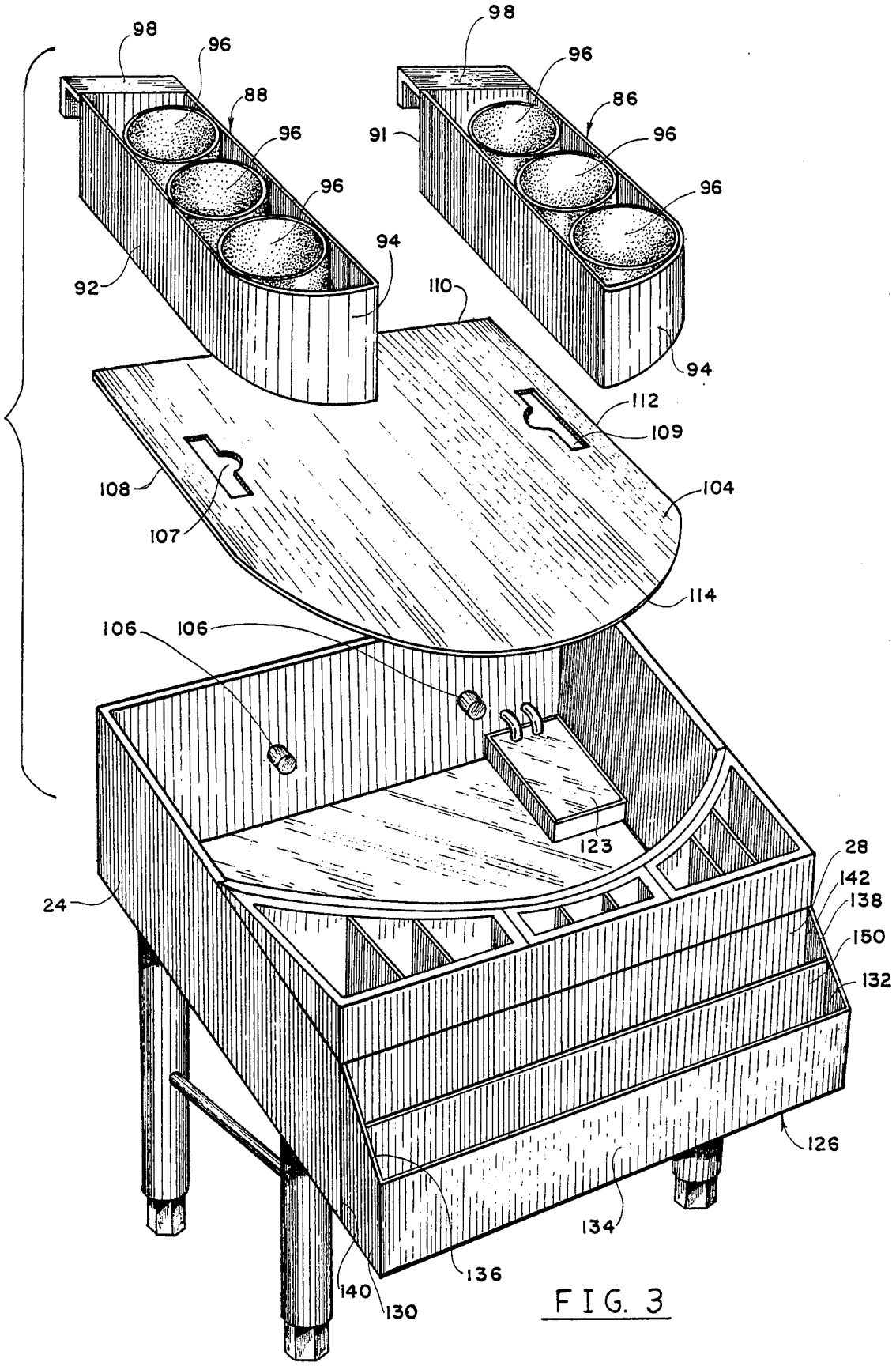
FIG. 3 is a partial exploded view of the apparatus of the present invention showing bottle holding bins and a cold plate mounted on the bottom of the housing.
Figure 4:
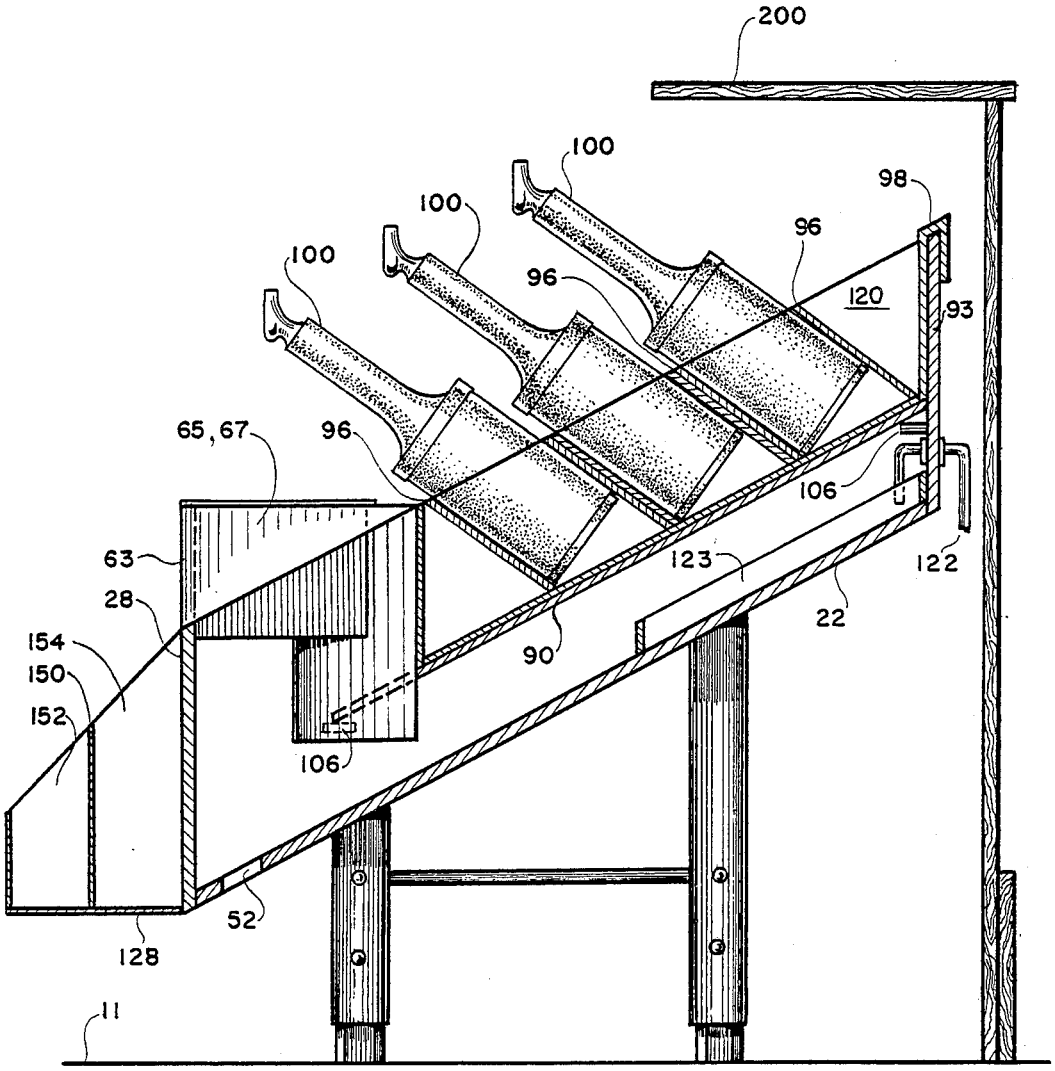
FIG. 4 is a cross-sectional side view of the apparatus of the present invention.

A pair of elongated side bins 86 and 88 (seen in FIGS. 1, 3 and 4) are provided for positioning inside the housing 20 in substantially parallel relationship to side walls 24 and 26.

The bins 86 and 88 each have a closed bottom 90 and vertically extending walls 91, 92 and 93. The walls 91 and 93 have a rectangular shape, while the walls 92 each have an arcuate portion 94, corresponding to the arc formed by the arcuate wall 58 at the place when the walls 92 contact the wall 58. The bins 86 and 88 are designed to occupy the space between the wall 58 and the back wall 30 of the housing 20.

A plurality of cylindrical inserts 96 are positioned within bins 86 and 88, at an angle to the bottom 90.

Such arrangement allows for positioning of bottles 101 within the bins 86 and 88 in such a manner that the top of the bottles 101 is inclined towards the front wall 28 of the housing 20, towards the bartender. This provides for easy handling of the bottles, which when positioned in the bins 86 and 88, can be easily withdrawn from the bins 86 and 88 by sliding them out of the compartments 96 at an angle to the bartender, in constrast to traditionally made vertical compartments, wherein an upwardly directed force must be exerted to remove the bottles from the compartments, thus adding an additional strain on the hands and back of the bartender, which becomes more important on a "busy night" when frequent withdrawals of the bottles need to be made in order to serve the customers.

The bins 86 and 88 are mounted on the top edge 66 of the back wall 30 through the use of L-shaped supports 98, which are fixedly attached to the top edges of the walls 93.

A substitute bottom insert 104 is provided for positioning inside the housing 20 in such a manner that the bottom plate of the insert 104 is positioned a distance above the bottom 22 of the housing 20.

As can be seen in the drawings, the insert 104 rests on a plurality of pegs 106 extending inwardly from the walls 30 and 58.

The insert 104 has three straight sides 108, 110 and 112 and one arcuate side 114, which matches the arc of the arcuate wall 58 of the insert 56. A pair of cutouts 107 and 109 are made adjacent sides 108 and 112 to allow manual positioning and removal of the substitute bottom plate 104 from the housing 20. The plate 104 is engaged by both hands of the bartender through the use of the cutouts 107 and 109.

When insert 104 is in place a reduced volume chamber 120 is formed by the insert 104 and upper portions of walls 24, 26, 30 and 58.

A number of hose attachments 122 extend from the back wall 30 of the housing 20, the hoses being adapted for connecting to a cold plate 123 of soft drinks or juices at one end and for extending into the interior of the chamber 32, for dispensing the soft drinks, on the other end. In this manner, the whole cold plate will be covered by ice which is deposited into the chamber 32 or 120, thus providing additional cooling effect on the soft drink or other liquid being dispensed. Additional advantage of the arrangement, wherein the hoses extend through the back wall 30 of the housing 20 is such that the hoses are removed from the way of the bartender and do not interfere with his movements while he is mixing drinks.

In the currently available standard bar units, the hoses extend over the top of the bar unit, and present inconvenience to the bartender by tangling at the back of the unit adjacent the bar counter top 200.

When required, the insert 104 can be easily withdrawn from its stored position and lowered into the chamber 32 to rest on pegs 106 and form a substitute chamber 120 as described hereinabove.

Additional features of the apparatus of the present invention is an attachment 126 fixedly attached to the front wall 28 of the housing 20.

The attachment 126 is formed by bottom 128, perpendicularly extending from the bottom 128 side walls 130 and 132 and front wall 134. The front wall 28 of the housing 20 serves as a back wall for the attachment 126. The side walls 130 and 132 have a trapezoidal shape, with the sides 136 and 138 sloping downwardly in the direction of the front wall 134, while sides 140 and 142 of the walls 130 and 132, respectively have vertical dimensions approximating that of the front wall 28 of the housing 20. The vertical dimensions of the sides 144 and 146 of the side walls 130 and 132, respectively, are considerably smaller. A dividing plate 150 extends across the attachment 126 in parallel relationship to the front wall 134 of the attachment 126, so that two elongated chambers, 152 and 154, are formed within the attachment 126. The chambers 152 and 154 are sized to accommodate large bottles (not shown) with various liquids placed on the bottom 128 in one row within the chambers 152 and 154. The inclined top edge of the side walls 130 and 132 allows easy observation of the bottles positioned within the chambers 152 and 154.

In operation, an insert 56 is positioned within the chamber 32 of the housing 20, irregular bins 74, 76 and 78 are inserted into the chambers 68, 70 and 72, while elongated bins 86 and 88 are suspended from the back wall 30 of the housing 20.

The chamber 32 is filled with ice, which will have twice as much volume as the volume of ice which can be deposited into a conventional bar unit, due to the inclined botton and utilization of under-the-bar space of the housing 20, which affords substantially greater volume for the chamber 32.

The fruit is placed into the compartments 74, 76 and 78 which may also house stirrers, matches and other necessary items, if need be.

Bottles containing juices or other liquids are placed in the compartments 97 of the elongated bins 86 and 88, with the top of the bottles directed towards the bartender.

Bottles containing liquor or other liquids are placed in compartments 152 and 154 of the attachment 126.

When it is necessary to reduce the size of the chamber 32, a substitute bottom plate 104 is positioned inside the chamber 32 to reduce the volume of the chamber and allow for less ice to be stored in the housing 20, while saving on electricity expenses since the ice machine runs less. Alternatively, the insert 104 can be positioned inside the chamber 32 for the same purpose of reducing the size of the chamber when less ice needs to be stored and utilized on a "slow night". The unit is thus ready for use by the bartender, with all necessary equipment being easily accessible for the bartender. The arcuate wall 58 of the insert 56 serves as a convenient wall for scooping ice from the housing 20.

The housing 20 can be made of stainless steel or plastic suitable to use with food products, in accordance with sanitary requirements.

Alternatively, the housing can be made of stainless steel, while the bins 86 and 88 or 74, 76 and 78 can be made of plastic, can be easily removed from the housing 20 and cleaned, if necessary.

Many modifications and changes can be made in the design of the bar unit in accordance with the present invention, without departing from the spirit and scope of the invention. Therefore, I pray that my rights to the present invention be limited only by the scope of the appended claims.

I claim:

1. A bar unit, comprising:

a housing having an inclined closed bottom, vertically extending walls attached to the bottom, such that an upper edge of a rear wall is on a higher vertical level than an upper edge of a front wall, said housing having an open top, and being mounted on and supported by a vertically adjustable leg means, said housing being provided an arucate insert means positionable inside the housing, said insert means having a vertically extending arcuate wall, said arcuate wall facilitating scooping of a material deposited into the housing.

2. The apparatus of claim 1, wherein said arcuate wall has a vertical dimension approximating a vertical dimension of the vertically extending walls of the housing.

3. The apparatus of claim 2, wherein a substitute bottom plate means is provided for positioning inside the housing at a distance from the bottom of the housing, said substitute bottom means having one arcuate side, the arc of the substitute bottom plate means conforming to an arc of the insert means.

4. The apparatus of claim 3, wherein said housing comprises a front wall and said substitute bottom plate means is supported inside the housing by supporting means extending inwardly into the housing from the front wall of the housing and the arcuate wall of the arcuate insert means at a distance above the bottom of the housing.

5. The apparatus of claim 4, wherein said supporting means comprise at least one peg extending from an arcuate wall of the arcuate insert means towards interior of the housing and at least one peg extending from the back wall of the housing towards the interior of the housing.

6. The apparatus of claim 3, wherein said substitute bottom plate means is provided with at least one opening allowing manual lifting and positioning of the substitute bottom plate means inside the housing.

7. The apparatus of claim 2, wherein said insert means is provided with a horizontal attachment means having at least one chamber therein for receiving at least one bin divided into a plurality of compartments by slidably removable dividing plates, said horizontal attachment means occupying spandrel space forward from the arcuate wall.

8. The apparatus of claim 7, wherein said housing is provided with a top edge, and said horizontal attachment means is provided with a support means allowing positioning of the horizontal attachment means on the top edge of the housing in a substantially horizontal orientation.

9. The apparatus of claim 8, wherein said support means for supporting horizontal attachment means comprise a front support having a generally rectangular form and a pair of side supports having a generally triangular shape, with a hypotenuse of triangles resting on top of the side walls of the housing.

10. The apparatus of claim 7, wherein said bin is provided with a horizontal lip extending about a periphery of the bin for supporting said bin on the horizontal attachment means of the insert means.

11. The apparatus of claim 1, further comprising at least one elongated bin positionable inside the housing, said elongated bin being divided into a plurality of compartments by a plurality of angularly inclined holding means for receiving bottles positionable within the compartments at an angle in relation to a front of the housing.

12. The apparatus of claim 1, wherein said vertically adjustable leg means comprise at least one leg having a lower and an upper portion, the upper portion telescopically engaging at least a part of the lower portion and being securable in a predetermined relationship to the lower portion by a securing means.

13. The apparatus of claim 1, wherein said housing comprises a front wall, and a secondary attachment means is provided for receiving bottles positionable within the secondary attachment means forward from the front wall of the housing.

14. The apparatus of claim 13, wherein said secondary attachment means comprises a bottom extending substantially perpendicularly from the front wall of the housing and fixedly attached thereto, a front wall and a pair of side walls, the side walls being fixedly attached to a front wall of the housing, the side walls having a generally trapezoidal shape.

15. The apparatus of claim 14, wherein the front wall of the secondary attachment means has a vertical dimension smaller than the vertical dimension of the front wall of the housing.

16. The apparatus of claim 15, wherein said secondary attachment means is divided into elongated chambers by dividing means extending inside the housing is substantially parallel relationship to the front wall of the housing.

17. A bar unit, comprising:

a housing having a forwardly inclined bottom, vertically extending side walls attached to the bottom and an open top, said housing being mounted on and supported by a vertically adjustable leg means, allowing variation of a distance of the bottom of the housing in relation to a horizontal plane formed by a floor and an arcuate insert means positionable inside the housing and having a vertically extending arcuate wall facilitating scooping of a material deposited inside the housing.

18. A bar unit, comprising:

a housing having an inclined bottom, vertically extending walls and an open top, said housing being supported by a plurality of vertically adjustable leg means, at least one of the leg means comprising an upper portion and a lower portion, said upper portion telescopically engaging at least a part of the lower portion;

an arcuate insert means having an arcuate wall adapted for positioning inside the housing, said first insert means having a vertical dimension approximating a vertical dimension of the housing walls;

a horizontal attachment means fixedly attached to a top edge of the arcuate insert means and adapted for positioning on a top edge of a front wall of the housing and at least part of side walls of the housing through the use of supports extending downwardly from sides of the horizontal attachment means, said horizontal attachment means having at least one chamber therein for receiving at least one bin divide into a plurality of compartments by slidably removable dividing plates, said horizontal attachment means occupying spandrel space forward from the arcuate wall;

at least one elongated bin positionable inside the housing, said elongated bin being divided into a plurality of compartments by a plurality of angularly inclined holding means for receiving bottles positionable within the compartments at an angle in relation to a front of the housing;

a secondary attachment means fixedly connected to a front wall of the housing, a bottom of the secondary attachment means having a substantially horizontal orientation, said secondary attachment means further comprising a front wall and a pair of side walls, the side walls having a generally trapezoidal shape, a top side of the side walls inclined downwardly toward a front wall of the secondary attachment means, said secondary attachment means being adapted for receiving a plurality of bottles therein.

19. The apparatus of claim 18, wherein a substitute bottom plate means is provided for positioning inside the housing at a distance from the bottom of the housing and supportable on support means extending to interior of the housing from a back wall of the housing and the arcuate wall of the arcuate insert means.

20. A bar unit, comprising:

a housing having an inclined bottom, vertically extending walls and an open top, said housing being supported by a plurality of vertically adjustable leg means, at least one of the leg means comprising an upper portion and a lower portion, said upper portion telescopically engaging at least a part of the lower portion;

an arcuate insert means having a top edge and an arcuate wall adapted for positioning inside the housing, said first insert means having a vertical dimension approximating a vertical dimension of the housing walls;

a horizontal attachment means fixedly attached to the top edge of the arcuate insert means and adapted for positioning on a top edge of a front wall of the housing and at least part of side walls of the housing through the use of supports extending downwardly from sides of the horizontal attachment means, said horizontal attachment means comprising a support means having a front support member for resting on the top edge of the housing front wall and a pair of side support members each comprising an inclined bottom edge which matches an inclined top edge of the housing side walls thereby forming extensions of the housing side walls, said horizontal attachment means having at least one chamber therein for receiving at least one bin divided into a plurality of compartments by slidably removable dividing plates, said horizontal attachment means occupying spandrel space forward from the arcuate wall;

at least one elongated bin positionable inside the housing, said elongated bin being divided into a plurality of compartments by a plurality of angularly inclined holding means for receiving bottles positionable within the compartments at an angle in relation to a front of the housing;

a secondary attachment means fixedly connected to a front wall of the housing, a bottom of the secondary attachment means having a substantially horizontal orientation, said secondary attachment means further comprising a front wall and a pair of side walls, the side walls having a generally trapezoidal shape, a top side of the side walls inclined downwardly toward a front wall of the secondary attachment means, said secondary attachment means being adapted for receiving a plurality of bottles therein;

wherein a substitute bottom plate means is provided for positioning inside the housing at a distance from the bottom of the housing and supportable on support means extending to interior of the housing from a back wall of the housing and the arcuate wall of the arcuate insert means; and wherein said substitute bottom plate means is removably positionable within the housing.

* * * * *